US005348829A

United States Patent [19]

Uchiyama et al.

[11] Patent Number: 5,348,829

[45] Date of Patent: Sep. 20, 1994

[54] MONOCOMPONENT-TYPE DEVELOPER FOR DEVELOPING ELECTROSTATIC IMAGE AND IMAGE FORMING METHOD

[75] Inventors: Masaki Uchiyama, Ichikawa; Yasutaka Akashi, Yokohama; Masaaki Taya, Kawasaki; Makoto Unno, Tokyo, all of Japan

[73] Assignee: Canon Kabushiki Kaisha, Tokyo, Japan

[21] Appl. No.: 972,540

[22] Filed: Nov. 6, 1992

[30] Foreign Application Priority Data

Nov. 8, 1991 [JP] Japan ..... 3-293034

[51] Int. Cl.[5] ..... G03G 9/083

[52] U.S. Cl. ..... 430/106.6; 430/122

[58] Field of Search ..... 430/106.6, 137, 122

[56] References Cited

U.S. PATENT DOCUMENTS

| | | | |
|---|---|---|---|
| 2,297,691 | 10/1942 | Carlson | 95/5 |
| 3,405,682 | 10/1968 | King et al. | 118/637 |
| 3,666,363 | 5/1972 | Tanaka et al. | 355/17 |
| 3,866,574 | 2/1975 | Hardenrook et al. | 118/637 |
| 3,890,929 | 6/1975 | Walkup | 118/637 |
| 3,893,418 | 7/1975 | Liebman et al. | 118/637 |
| 4,071,361 | 1/1978 | Marushima | 96/1.4 |
| 5,014,089 | 5/1991 | Sakashita et al. | 355/251 |
| 5,021,315 | 6/1991 | Goldman | 430/137 |
| 5,169,738 | 12/1992 | Tanikawa et al. | 430/106.6 |

FOREIGN PATENT DOCUMENTS

| | | |
|---|---|---|
| 314459 | 5/1989 | European Pat. Off. . |
| 0331425 | 9/1989 | European Pat. Off. . |
| 420197 | 4/1991 | European Pat. Off. . |
| 54-43037 | 4/1979 | Japan . |
| 55-18656 | 2/1980 | Japan . |
| 55-18657 | 2/1980 | Japan . |
| 55-18658 | 2/1980 | Japan . |
| 55-18659 | 2/1980 | Japan . |
| 57-66455 | 4/1982 | Japan . |
| 60-73647 | 4/1985 | Japan . |

*Primary Examiner*—John Goodrow

*Attorney, Agent, or Firm*—Fitzpatrick, Cella, Harper & Scinto

[57] ABSTRACT

A monocomponent-type developer for developing electrostatic images, includes a magnetic toner containing at least a binder resin and magnetic powder, and 0.5–10 wt. % (based on the magnetic toner) of inorganic fine powder having a length-average particle size of 0.1–5 μm. The developer has a number-basis particle size distribution such that particles of 4 μm or smaller are contained at 5–18% by number and particles of 4–10 μm are contained at at least 60% by number. The developer has a volume basis particle size distribution such that particles of 12.7 μm or larger are contained at at most 10% by volume. The developer has a weight-average particle size of 7–11 μm. The developer is particularly useful for development under application of a DC-superposed asymmetric AC bias electric field including a development-side voltage component with a larger magnitude and a shorter duration than a reverse development-side voltage component.

37 Claims, 4 Drawing Sheets

MONOCOMPONENT-TYPE DEVELOPER FOR DEVELOPING ELECTROSTATIC IMAGE AND IMAGE FORMING METHOD

FIELD OF THE INVENTION AND RELATED ART

The present invention relates to a monocomponent-type developer for developing an electrostatic latent image formed in processes, such as electrophotography, electrostatic printing and electrostatic recording and an image forming method using the developer.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy.

Various developing methods for visualizing electrostatic images have also been known, inclusive of a class of methods wherein developing is effected under application of bias voltages, e.g., as disclosed in U.S. Pat. Nos. 3,866,574; 3,890,929; and 3,893,418.

For example, it has been proposed to control the jumping of a high-resistivity monocomponent toner between a latent image-bearing member and a toner carrying member disposed to form a spacing therebetween by applying a non-symmetrical AC pulsed bias voltage. More specifically, in the developing method, the latent image-bearing member and the developer-carrying member are disposed with a spacing of 50–500 μm, preferably 50–180 μm. The frequency is 1.5–10 kHz, preferably 4–8 kHz. The development time $T_A$ is set to satisfy 10 μsec$\leqq T_A \leqq$200 μsec, preferably 30 μsec$\leqq T_A \leqq$200 μsec. The peeling (or reverse development) time $T_D$ is set to satisfy 100 μsec$\leqq T_D \leqq$500 μsec, preferably 100 μsec$\leqq T_D \leqq$180 μsec. The development voltage $V_A$ and the peeling voltage $V_D$ are set to satisfy $V_A \geqq -150$ V, $V_D \geqq 400$ V, and $V_D - V_A \leqq 800$ V, preferably $-150$ V$\leqq V_A \leqq -200$ V and 400 V$\leqq V_D \leqq$450 V. According to this system, the jumping and attachment of toner particles onto non-image parts are prevented to improve the gradation characteristic and the high-reproducibility.

According to a developing method as described above wherein the absolute value of AC bias voltage is suppressed to a low value and the development voltage is made small, a sufficient image density cannot be obtained in some cases.

As latent-image developing methods using a high-resistivity monocomponent toner (with a volume resistivity of $10^{10}$ ohm.cm or higher), there have been known the impression developing method (U.S. Pat. No. 3,405,682, etc.) and the jumping developing method (Japanese Laid-Open Patent Applications JP-A 55-18656 to 18659, etc.). According to the jumping developing method, in a development region which is formed at the closest part between a developer-carrying member and a latent image-bearing member, a toner is reciprocally moved between the developer-carrying member and the latent image-bearing member under application of an AC bias voltage between the developer-carrying member and the latent image-bearing member to be finally transferred and attached selectively to the surface of the latent image-bearing member corresponding to a latent image pattern to visualize the latent image. The duty ratio at this time is 50%, and accordingly the development time and the reverse development time are the same.

It has been also proposed in the jumping developing method to control the duty ratio of the AC bias voltage applied between the developer-carrying member and the latent image-bearing member depending on the residual amount of the toner so as to adjust the image density (JP-A 60-73647).

In the developing method using a high-resistivity mono-component developer, a solid latent image (high potential region) is effectively developed because of a high development-side bias voltage whereas the developed toner image is liable to be peeled excessively because of a large reverse development-side bias voltage in a low potential region, thus resulting in an image lacking a gradation characteristic. Further, there is left a narrow latitude for setting the parameters for the development-side voltage (DC component and AC voltage (amplitude Vpp and frequency)). When the voltage is adjusted (by lowering the DC component or raising the AC component) so as to increase the density, a ground fog is liable to occur. An increase in AC frequency is effective for suppressing the ground fog but also functions to make thinner character or line images to result in poor reproducibility of such images.

The above-mentioned two types of developing methods can be improved by applying a higher development side bias voltage while setting a short time therefor, so that it becomes possible to obtain images which have a high image density, are rich in gradation characteristic and are free from ground fog.

When the image forming method adopting the above developing method is repetitively applied, deterioration of image qualities have been encountered in some cases, such as a lowering in image density, an increase in ground fog, or deterioration in resolution or line-reproducibility.

In a specific case where the above-mentioned difficulties were encountered, the particle size distribution of the toner remaining in the developing apparatus was examined whereby the change in particle size distribution was observed as compared with that of the initial stage and the deterioration in image qualities was found to be caused by the change in particle size distribution of the toner due to selective consumption of toner in a particular particle size range.

There are two important requirements A and B as described below in a developing method using an insulating magnetic developer. Requirement A: To form a uniform coating layer of magnetic developer on a developer-carrying member. Requirement B: To uniformly and effectively charge the magnetic developer triboelectrically. It has been hitherto tried to satisfy the requirements A and B in combination.

For the requirement A of forming a uniform layer of developer on a developer-carrying member, it has been known to dispose a coating blade at the outlet of a developer container. For example, in a developing apparatus, a blade comprising a magnetic material is disposed opposite to a magnetic pole of a fixed magnet enclosed within a developer-carrying member to form ears of the developer along magnetic lines of force acting between the magnetic pole and the magnetic blade and cut the ears with the tip edge of the blade, thereby regulating the thickness of the resulting developer layer under the action of the magnetic force (e.g., as disclosed in JP-A 54-43037).

As for the requirement A, a method of forming a uniform toner coating layer of a magnetic toner on a developer-carrying member is also proposed by JP-A 57-66455. In the developing apparatus for effecting the method, the surface of a developer-carrying member is provided with an indefinite unevenness pattern by sandblasting the surface with irregular-shaped particles, so as to always provide a uniform developer coating state for a long period of time. The entire surface of the developer-carrying member thus treated has minute cuttings or projections disposed at random.

A developing apparatus using a developer-carrying member having such a specific surface state can result in deterioration of developing characteristics, such as fog and lower image density depending on the magnetic developer used. This is caused by occurrence of insufficiently charged toner particles in the monocomponent developer leading to a lowering in electric charge of the developer layer. In some cases, other difficulties can be encountered, such as tailing, scattering, or instability of reproduction of thin lines.

As for the requirement B, in order to provide a developer-carrying member with an enhanced ability of triboelectrically charging a magnetic toner, it has been proposed to make smoother the surface of a developer-carrying member. According to such a method, however, the coating of a monocomponent-type developer can become uniform to result in irregularities in developed images, thus failing to provide good images.

A developing method for achieving the requirements A and B in combination has been proposed (EP-A-0331425). The developing method uses a developer-carrying member having a surface subjected to blasting with definite-shaped particles in combination with a monocomponent-type developer having a specific particle size distribution so as to be capable of forming a uniform developer coating layer for a long period.

However, even if a developer-carrying member having such a specific surface and a monocomponent-type developer having such a specific particle size are used in combination, the developer-carrying member surface is gradually worn and changed into a smooth surface during use for a long period to lose an initial effect obtained by blasting with definite O-shaped particles, thus a non-uniform developer coating layer may result accompanied by a developer coating irregularity. These factors result in images having a low image density and accompanied by irregular fog attributable to the coating irregularity in the background. This problem is noticeable in a low humidity environment, particularly in an environment of normal temperature and very low humidity.

On the other hand, in a high-speed copying machine, an improved reliability is a crucial requirement, and it is required to stably provide high-quality images even over a long period of successive copying operation of several hundreds of thousand sheets or more. Accordingly, it is desired to provide a monocomponent-type developer capable of providing stable images even in case where the developer-carrying member surface is in a smooth uneven state.

In general, when image formation is repeated according to the monocomponent developing system, toner particles having a small particle size can be attached to the surface of the developer-carrying member because of an image force due to their high electric charge so that triboelectrification of the other particles can be hindered. As a result, the proportion of toner particles having insufficient charge is increased to cause a lowering in image density in some cases. This phenomenon is liable to be encountered particularly under the low-humidity condition.

The above phenomenon is promoted when the toner on the developer-carrying member is not consumed, e.g., so as to provide a white ground image, and results in a decrease in image density. This phenomenon is alleviated to gradually restore an intended image density when the toner on the developer-carrying member is consumed, e.g., so as to provide a black image part.

Thus, there are formed a consumed part where the toner has been consumed and an unconsumed part where the toner has not been consumed on a developer-carrying member as a result of previous developing operation. When such a developer-carrying member having a memory of the previous developing operation is subjected to latent image formation and development, there can result in differences in tone image density, i.e., a higher density at the consumed part and a lower density at the unconsumed part.

The above-mentioned phenomenon is hereinafter called "developer-carrying member memory" or "sleeve memory". The developer-carrying member memory can be solved by the consumption of the toner on the developer-carrying member as is understood from the mechanism of the occurrence. Thus, the developer-carrying member memory is alleviated for each one rotation of the developer-carrying member. Accordingly, a light degree of developer-carrying member memory disappears from the developed image after one rotation, but a serious developer-carrying member memory repeatedly appears in several developed images.

According to our study, a developer-carrying member subjected to blasting with definite-shaped particles has better charge-imparting ability than a developer-carrying member subjected to blasting with indefinite-shaped particles and is thus more advantageous in charging a toner. In some cases, however, such a developer-carrying member is liable to excessively charge a toner to result in the developer-carrying member memory.

On the other hand, the above-mentioned latent image-bearing member may comprise a photosensitive member for electrophotography, which may for example comprise Se, CdS, an organic photoconductor (OPC), and amorphous silicon (hereinafter called "a-Si").

In recent years, a variety of electro-photographic copying machines are required for reproducing color images, for personal use, for intelligent use and for maintenance-free use. As a result, a photoconductor having a novel characteristic and a high stability has been desired and has been developed. Among them, a-Si has been calling attention.

Amorphous silicon has high sensitivities over the entirety of visible wavelength regions so that it is also applicable to a semiconductor laser and color image formation. Moreover, it has a high surface hardness as represented by a Vickers hardness of 1500–2000 and is expected to have a long life as represented by a copying or printing durability of $10^6$ sheets or more. Further, a-Si also has a sufficient heat-resistance which is satisfactory for practical use of electrophotographic copying machines.

Generally, an a-Si photosensitive member is said to have a surface dark (part) potential which depends on the thickness.

The surface dark potentials of commercially used photosensitive members are required to be 500 V at the minimum for CdS photosensitive members and 600–800 V for Se photosensitive members and OPC photosensitive members. An a-Si photosensitive member is required to have a large thickness for reaching such potentials in view of variation in various characteristics and possible decrease in sensitivity due to changes in environmental conditions.

As a result, such a large thickness of a-Si photosensitive member is inevitably accompanied with an increase in production cost and a decrease in production efficiency. The increase in thickness is liable to be accompanied with abnormal growth of the a-Si film and formation of a locally ununiform a-Si film, which leads to a difficulty in practical use of the a-Si photosensitive member.

In order to deal with the problem, it has been proposed to make thinner the a-Si photosensitive member so as to satisfy the productivity, production cost and performances thereof. In order to use a thin a-Si photosensitive member, it is necessary to adopt a developing method capable of development at a low potential. While use of a thin a-Si photosensitive member is satisfactory in respects of production cost, capacity and photosensitive performances, it results in a lower surface potential, and attachment of impurities onto the surface under a high humidity condition which leads to lower photosensitive characteristics and image flow in the resultant image. A practical a-Si provides a surface dark potential of about 400 V, and the stably applicable potential is about 300 V. In such a case of a low developing contrast of 300 V between the light and dark parts providing a developing contrast of 150–250 V, it is extremely difficult to obtain a sufficient density of solid black by an ordinary developing method. Herein, the developing contrast in normal development refers to the absolute value of a difference obtained by subtracting a developing potential from an average dark part potential over a photosensitive member.

Hitherto, a method of using a magnetic toner containing 12% by number or more of particles of 5 μm or smaller having a large chargeability so as to improve the image quality has been proposed (e.g., JP-A 3-111855). Magnetic toner particles of 5 μm or smaller cause a strong image force on the surface of a developing sleeve as a developer-carrying member, thus being liable to stick onto the sleeve surface and be affected by the sleeve surface. Further, even a sleeve having a good surface characteristic at the initial stage is liable to change its surface characteristic within a long period of successive operation. Such a sleeve is liable to cause a developer coating irregularity on the sleeve surface and image difficulties, such as density lowering, roughening and background fog, due to magnetic toner fine powder in the monocomponent-type developer.

Accordingly, it is desired to provide a monocomponent-type developer capable of developing low-potential latent images, such as those formed on a thinner a-Si photosensitive member.

SUMMARY OF THE INVENTION

An object of the present invention is to provide a monocomponent-type developer having solved the above-mentioned problems, and an image forming method using the developer and an asymmetric developing bias voltage.

A more specific object of the invention is to provide a monocomponent-type developer excellent in durability and capable of stably providing images having a high density and free from background fog even in a long period of repetitive use, and an image forming method using the developer.

Another object of the invention is to provide a monocomponent-type developer capable of providing a high image density without causing image flow even under a high humidity condition, and an image forming method using the developer.

A further object of the invention is to provide a monocomponent-type developer capable of stably providing images having a high image density and free from background fog even under a very low-humidity condition, and an image forming method using the developer.

A still further object of the invention is to provide a monocomponent-type developer capable of faithfully developing electrostatic latent images having a low developing potential contrast as obtained on an a-Si photosensitive member to provide images which are rich in gradation characteristic and excellent in resolution and thin-line reproducibility.

According to the present invention, there is provided a monocomponent-type developer for developing electrostatic images, comprising: a magnetic toner containing at least a binder resin and magnetic powder, and 0.5–10 wt. % (based on the magnetic toner) of inorganic fine powder having a length-average particle size of 0.1–5 μm;

wherein the developer has a number-basis particle size distribution such that particles of 4 μm or smaller are contained at 5–18% by number and particles of 4–10 μm are contained at at least 60% by number;

the developer has a volume basis particle size distribution such that particles of 12.7 μm or larger are contained at at most 10% by volume: and the developer has a weight-average particle size of 7–11 μm.

According to the present invention, there is further provided an image forming method, comprising:

disposing a latent image-bearing member for holding an electrostatic image thereon and a developer-carrying member for carrying a monocomponent-type developer with a prescribed gap at a developing station; the monocomponent-type developer comprising a magnetic toner containing at least a binder resin and magnetic powder, and 0.5–10 wt. % (based on the magnetic toner) of inorganic fine powder having a length-average particle size of 0.1–5 μm; wherein the developer has a number-basis particle size distribution such that particles of 4 μm or smaller are contained at 5–18% by number and particles of 4–10 μm are contained at at least 60% by number; the developer has a volume basis particle size distribution such that particles of 12.7 μm or larger are contained at at most 10% by volume; and the developer has a weight-average particle size of 7–11 μm;

conveying the monocomponent-type developer in a layer carried on the developer-carrying member and regulated in a thickness thinner than the prescribed gap to the developing station: and applying an alternating bias voltage comprising a DC bias voltage and an asymmetric AC bias voltage in superposition between the developer-carrying member and the latent image-bearing member at the developing station to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the developer on the developer-carrying member is transferred to the latent image-bearing member to develop the electrostatic image thereon at the developing station.

These and other objects, features and advantages of the present invention will become more apparent upon a consideration of the following description of the preferred embodiments of the present invention taken in conjunction with the accompanying drawings.

DETAILED DESCRIPTION OF THE INVENTION

We made a study on the relationship between a toner particle size and a developing characteristic under application of a developing bias (voltage) by using magnetic toners having a particle size distribution ranging from 0.5 to 30 μm. It was intended to observe a pulse duration at which a magnetic toner began to attach to a latent image-bearing member (to provide an image density of 1.0 or above after the transfer and fixation) in a case where a certain development-side voltage (about 1000 V) in the form of a pulse was applied between a developer-carrying member and the latent image-bearing member (disposed with a spacing of about 250 μm) in connection with the particle size distribution of the toner. When a latent image was developed at a constant surface potential on the latent image-bearing member while changing the pulse duration, and the magnetic toner particles used for development of the latent image-bearing member were collected for measurement of the particle size distribution thereof, it was found that there were many magnetic toner particles having a size of 8 μm or smaller and also there were many magnetic toner particles having a size of 5 μm or smaller in the case where the pulse duration was 200 μsec or shorter. When the pulse duration was made even smaller, the proportion of the magnetic toner particles of 5 μm or smaller was found to be increased. From these facts, it is understood that a magnetic toner particle having a smaller particle size reaches a latent image-bearing member in a shorter time.

Accordingly, at the time of application of a development-side bias voltage, it is possible to use a smaller magnetic toner particle selectively or preferentially for development by setting the bias to be higher and the application time to be shorter.

On the other hand, at the time of application of a reverse development-side bias voltage, by setting the (peeling) voltage to be lower and the application time to be longer, it becomes possible to definitely return a large magnetic toner particle or a magnetic toner particle having a small charge (thus having a slow moving speed) to the developer-carrying member in a sufficient time. In this instance, a small magnetic toner particle attached to an image part on the latent image-bearing member is not substantially peeled because of a large image force and the low peeling voltage.

As a result, by applying a developing method using a developing bias voltage characteristic to the present invention, developed images having a high image density can be obtained with good gradation characteristic and thin-line reproducibility.

Figure 3:
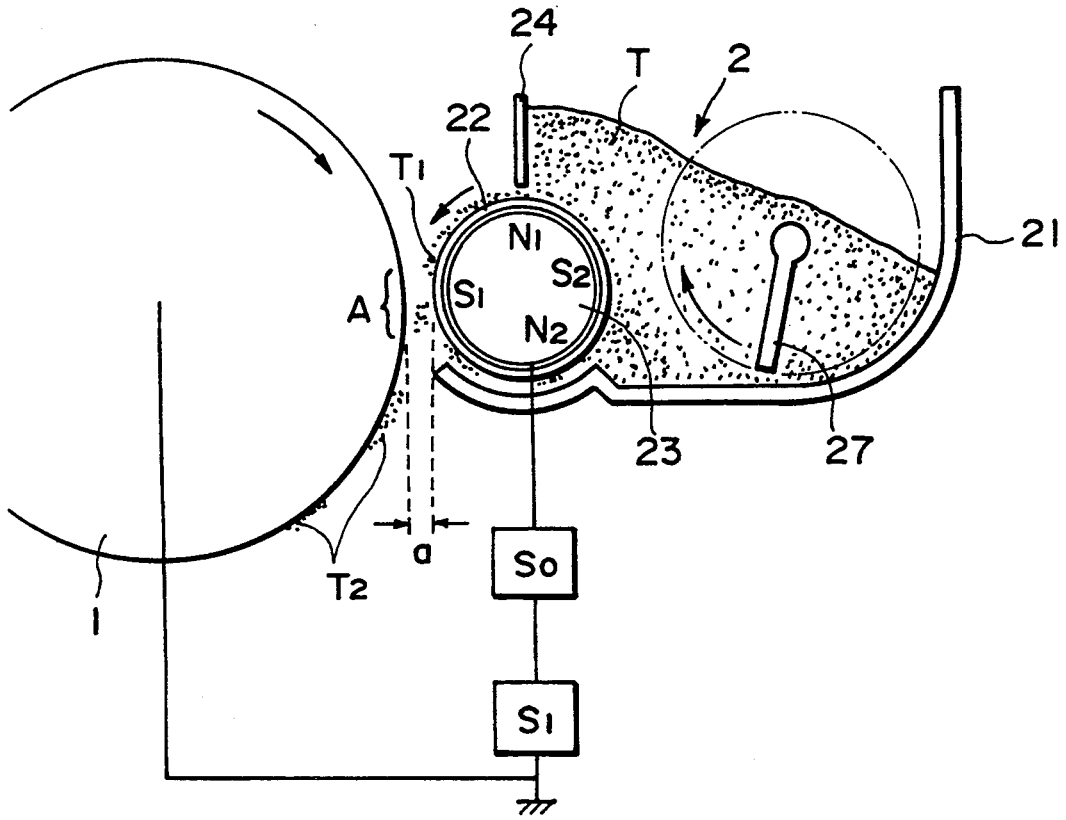
FIG. 3 is an illustration of an image forming apparatus for practicing an embodiment of the image forming method according to the present invention.

The features of the present invention will now be explained with reference to FIG. 3 showing an image forming apparatus for practicing an embodiment of the image forming method according to the present invention.

Referring to FIG. 3, the apparatus includes a latent image-bearing member 1 which can be a latent image-bearing member (so-called photosensitive member), such as a rotating drum, for electrophotography; an insulating member, such as a rotating drum, for electrostatic recording; photosensitive paper for the Electrofax; or electrostatic recording paper for direct electrostatic recording. An electrostatic latent image is formed on the surface of the latent image-bearing member 1 by a latent image forming mechanism or latent image forming means (not shown) and the latent image-bearing member is rotated in the direction of an indicated arrow.

The apparatus also includes a developing apparatus which in turn includes a developer container 21 (hopper) for holding a monocomponent-type developer and a rotating cylinder 22 as a developer-carrying member (hereinafter, also called "(developing) sleeve") in which a magnetic field-generating means 23, such as a magnetic roller, is disposed.

Almost a right half periphery (as shown) of the developing sleeve 22 is disposed within the hopper 21 and almost a left half periphery of the sleeve 22 is exposed outside the hopper. In this state, the sleeve 22 is axially supported and rotated in the direction of an indicated arrow. A doctor blade 24 as a developer layer regulating means is disposed above the sleeve 22 with its lower edge close to the upper surface of the sleeve 22. A stirrer 27 is disposed for stirring the developer within the hopper 21.

The sleeve 22 is disposed with its axis being in substantially parallel with the generatrix of the latent image-bearing member 1 and opposite to the latent image-bearing member 1 surface with a slight gap $\alpha$ therefrom.

The surface moving speed (circumferential speed) of the sleeve 22 is substantially identical to or slightly larger than that of the latent-image bearing member 1. Between the latent image-bearing member 1 and the sleeve 22, a DC voltage and an AC voltage are applied in superposition by an alternating bias voltage application means $S_0$ and a DC bias voltage application means $S_1$.

In the image forming method of the present invention, not only the magnitude of the alternating bias electric field but also the application time thereof are controlled as well as a triboelectric charge adapted to the controlling developing bias voltage. More specifically, as for the alternating bias, the frequency thereof is not changed, but the development-side bias component is increased while the application time thereof is shortened and correspondingly the reverse development-side bias component is suppressed to a low value while the application time thereof is prolonged, thus changing the duty ratio of the alternating bias voltage.

In the present invention, the development-side bias (voltage) component refers to a voltage component having a polarity opposite to that of a latent image potential (with reference to the developer-carrying member) on the latent image-bearing member (in other words, the same polarity as the toner for developing the latent image), and the reverse development-side bias (voltage) component refers to a voltage component having the same polarity as the latent image (opposite polarity to the toner).

Figure 4:
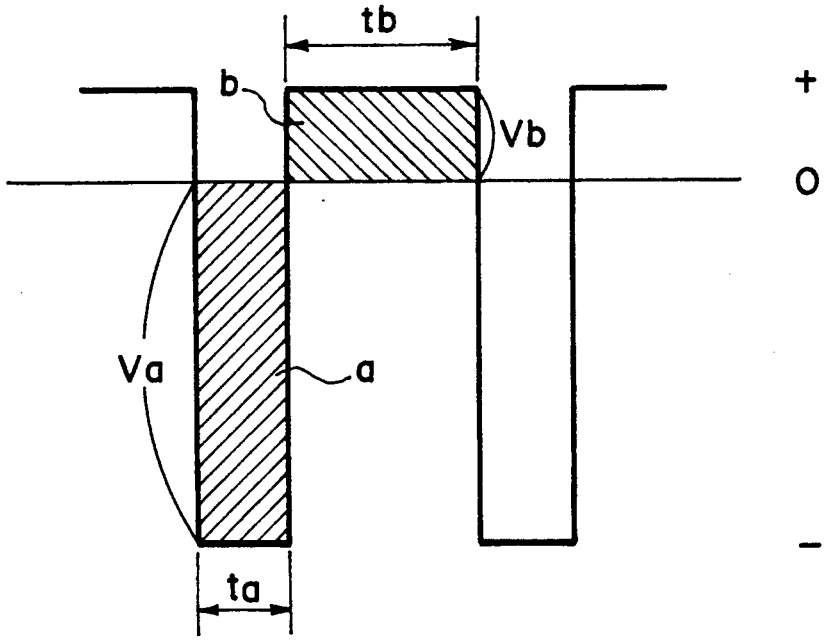
FIG. 4 is a waveform diagram illustrating bias voltage components.

For example, FIG. 4 shows an example of an asymmetrical alternating bias voltage comprising an AC bias voltage and a DC bias voltage. FIG. 4 refers to a case where a toner having a negative charge is used for developing a latent image having a positive potential with reference to the developer-carrying member. The part a refers to a development-side bias component and the part b refers to a reverse development-side bias component. The magnitudes of the development-side component and the reverse development-side component are denoted by the absolute values of Va and Vb.

In the present invention, the duty ratio of the alternating bias voltage is defined as follows:

$$\text{Duty ratio} = t_a/(t_a+t_b)\ (\times 100)\ \%,$$

wherein $t_a$ denotes the duration of a voltage component with a polarity for directing the toner toward the latent image-bearing member (constituting the developing side bias component a), and $t_b$ reversely denotes the duration a voltage component with a polarity for peeling the toner from the latent image-bearing member (constituting the reverse development-side bias component b), respectively, within one cycle of the alternating bias voltage.

Almost a right half periphery of the developing sleeve 22 always contacts the developer within the hopper 21, and the developer in the vicinity of the sleeve surface is attached to and held on the sleeve surface under the action of a magnetic force exerted by the magnetic field-generating means 23 disposed in the sleeve 23 and/or an electrostatic force. As the developing sleeve 22 is rotated, the developer layer held on the sleeve is leveled into a thin layer $T_1$ having a substantially uniform thickness when it passes by the position of the doctor blade 24. The charging of the magnetic toner is principally effected by triboelectrification through friction with the sleeve surface and the developer stock in the vicinity of the sleeve surface caused by the rotation of the sleeve 22. The thin magnetic developer layer on the developing sleeve 22 rotates toward the latent image-bearing member 1 as the sleeve rotates and passes a developing station or region A which is the closest part between the latent image-bearing member 1 and the developing sleeve 22. In the course of the passage, the magnetic toner in the developer layer on the developing sleeve 22 jumps under the action of DC and AC voltages applied between the latent image-bearing member 1 and the developing sleeve 22 and reciprocally moves between the latent image-bearing member 1 surface and the developing sleeve 22 surface in the developing region A. Finally, the magnetic toner on the developing sleeve 22 is selectively moved and attached to the latent image-bearing member 1 surface corresponding to a latent image potential pattern thereon to successively form a toner image $T_2$.

The developing sleeve surface having passed by the developing region A and having selectively consumed the magnetic toner thereon rotates back into the developer stock in the hopper 21 to be supplied again with the magnetic developer, whereby the thin developer layer $T_1$ on the developing sleeve 22 is continually moved to the developing region A when developing steps are repeatedly effected.

As described above, a problem accompanying such a developing scheme (non-contact developing method using a monocomponent developer) is that the developing performance can be decreased due to an increased force of attachment of magnetic toner particles in the vicinity of the developing sleeve surface in some cases. The magnetic toner and the sleeve always cause friction with each other as the developing sleeve 22 rotates, so that the magnetic toner is gradually caused to have a large charge, whereby the electrostatic force (Coulomb's force) between the magnetic toner and the sleeve is increased to weaken the force of flying or jumping of the magnetic toner. As a result, the magnetic toner is stagnant in the vicinity of the sleeve which hinders the triboelectrification of the other toner particles, thus resulting in a decrease in developing characteristic. This occurs particularly under a low humidity condition or through repetition of developing steps. Due to a similar mechanism, the above-mentioned developer-carrying member memory occurs.

The force of propelling the magnetic toner from the sleeve toward the latent image-bearing member 1 is required to provide an acceleration $\vec{a}$ so as to cause the magnetic toner to sufficiently reach the latent image surface under the action of an AC bias electric field. If the mass of a toner particle is denoted by m, the force $\vec{f}$ is given by $\vec{f}=m\cdot\vec{a}$. If the charge of the toner particle is denoted by q, the distance from the sleeve is denoted by d and the alternating bias electric field is denoted by $\vec{E}$, the force $\vec{f}$ is roughly given by $\vec{f}=\vec{E}\cdot q-(\epsilon\cdot\epsilon^0\cdot q^2)/d^2$. Thus, the force of toner reaching the latent image surface is determined by a balance between the electrostatic attraction force with the sleeve and the electric field force.

In this instance, toner particles of 5 μm or smaller which are liable to gather in the vicinity of the developing sleeve can also be jumped if the electric field is increased. However, if the development-side bias voltage is simply increased, the toner is caused to jump toward the latent image side regardless of the latent image pattern. This tendency is strong for toner particles of 4 μm or smaller, thus being liable to cause ground fog. The ground fog can be prevented by increasing the reverse development-side voltage, but if the alternating electric field acting between the latent image-bearing member 1 and the developing sleeve 22 is increased, a discharge is directly caused between the latent image-bearing member 1 and the sleeve 22 to remarkably impair the image quality in some cases.

Further, when the reverse development-side voltage is also increased, the toner attached not only to the non-latent image part but also to the latent image pattern (image part) is caused to be peeled. Thus, magnetic toner particles having a relatively small image force to the latent image-bearing member are liable to be removed so that the coverage on the latent image part becomes poor to cause image defects, such as disturbance of a developed pattern, deterioration of gradation characteristic and line-reproducibility and liability of hollow image (white dropout of a middle part of an image).

From the above results, it is important to cause the toner in the vicinity of the sleeve to fly or jump and reciprocally move without excessively increasing the alternating bias electric field and by suppressing the reverse development-side bias voltage to a low value.

Even if the reverse development-side bias electric field is weak, the duration thereof is prolonged so that the effective force for peeling from the latent image-bearing member remains identical. The toner image attached to the latent image is not disturbed so that a good image with a gradation characteristic is attained.

Under the action of the developing bias voltage according to the present invention, when ears formed of a magnetic toner jump and the tips of the ears touch the latent image-bearing member, the toner particles in the neighborhood of the ear tips, particles of a small particle size and particles having a large charge are attached to the latent image-bearing member for effecting development because of the image force, whereas the particles constituting the trailing ends or particles having a small charge are returned to the developer-carrying member under the action of the reverse development-side bias. Thus, the ears tend to be broken so that difficulties such as tailing and scattering due to ears can be alleviated.

According to the alternating bias electric field used in the present invention, the development-side-bias electric field is so strong as to cause toner particles near the sleeve surface to jump, so that toner particles having a large charge are more intensively used for development of a latent image pattern. As a result, toner particles having a large charge are firmly attached onto even a weak latent image pattern due to an electrostatic force, so that an image having a sharp edge can be obtained at a high resolution. Further, magnetic toner particles having a large charge are effectively used to provide a good image.

In the image forming method of the present invention, a satisfactory development may be effected for a gap of from 0.1 mm to 0.5 mm between the developing sleeve 22 and the latent image-bearing member 1 while 0.25 mm was representatively used in Examples described hereinafter.

While being dependent on the gap between the developing sleeve and the latent image bearing member, a satisfactory image can be obtained if the absolute value of the alternating bias voltage is 0.5 kV or higher. Taking a possible leakage to the latent image-bearing member into consideration, the peak-to-peak voltage of the alternating bias voltage may preferably be 0.5–3.0 kV, particularly 1.0–2.0 kV. The leakage can of course change depending on the gap between the developing sleeve 22 and the latent image-bearing member 1.

The frequency of the alternating bias may preferably be 1.0 kHz to 3.0 kHz. If the frequency is below 1.0 kHz, a better gradation can be attained but it becomes difficult to dissolve the ground fog. This is presumably because, in such a lower frequency region where the frequency of the reciprocal movement of the magnetic toner particles is smaller, the force of pressing the magnetic toner particles onto the latent image-bearing member due to the development-side bias becomes excessive even onto a non-image part, so that a portion of toner attached onto the non-image part cannot be completely removed by the peeling force due to the reverse development-side bias electric field. On the other hand, at a frequency above 3.0 kHz, the reverse development-side bias electric field is applied before the toner sufficiently contacts the latent image-bearing member, so that the developing performance is remarkably lowered. In other words, the toner per se cannot easily respond to such a high frequency electric field.

In the present invention, a frequency of the alternating bias electric field in the range of 1.5 kHz to 2.5 kHz provided an optimum image quality.

The duty ratio of the alternating bias electric field waveform according to the present invention may be substantially below 50%, preferably be a value satisfying: 20% ≦ duty factor ≦ 45% in view of the image quality and developing characteristic. If the duty factor is above 45%, the above-mentioned defects become noticeable to fail to achieve the improvement in image quality according to the present invention. If the duty factor is below 20%, the response of the toner to the alternating bias electric field becomes poor to lower the developing performance. The duty factor may optimally be in the range of 25 to 40% (inclusive).

The alternating bias waveform may for example be in the form of a rectangular wave, a sine-wave, a saw-teeth wave or a triangular wave.

The monocomponent-type developer according to the present invention will be described hereinbelow.

As a result of our further study on performances of monocomponent-type developers in relation with developing sleeves, we have found a monocomponent-type developer capable of providing images having a high image density and excellent in gradation characteristic and thin-line reproducibility under various environmental conditions.

More specifically, images having such excellent image qualities can be obtained by using a monocomponent-type developer comprising a magnetic toner containing at least a binder resin and magnetic powder, and 0.5–10 wt. % (based on the magnetic toner) of inorganic fine powder having a length-average particle size of 0.1–5 μm; wherein the monocomponent-type developer has a number-basis particle size distribution such that particles of 4 μm or smaller are contained at 5–18% by number and particles of 4–10 μm are contained at at least 60% by number; the monocomponent-type developer has a volume basis particle size distribution such that particles of 12.7 μm or larger are contained at at most 10% by volume; and the monocomponent-type developer has a weight-average particle size of 7–11 μm.

When a monocomponent-type developer comprising an external mixture of a magnetic toner and inorganic fine powder having a length-average particle size of 0.1–5 μm (preferably 0.5–3 μm) is used, the inorganic fine powder is selectively applied in the vicinity of the developing sleeve surface to form a very thin layer of the inorganic fine powder. As a result, the magnetic toner does not directly contact the developing sleeve surface, so that the magnetic toner is prevented from sticking onto the sleeve surface due to the image force, thus not being liable to cause a coating irregularity of the developer.

Further, if inorganic fine powder having a small charge of a polarity opposite to that of the magnetic toner is added, the inorganic fine powder is separated from the magnetic toner under application of a developing bias at the time of development, so that the charge of the magnetic toner can be increased. Accordingly, if inorganic fine powder having a length-average particle size of 0.1–5 μm, preferably 0.5–3 μm, is externally added in an amount of 0.5–10 wt. %, preferably 1–7 wt. %, based on the magnetic toner to the magnetic toner, the charge of the magnetic toner can be enhanced while preventing the sticking of the magnetic toner onto the developing sleeve surface because of the preferential presence of the inorganic fine powder at the developing sleeve surface. Herein, the length-average particle size of the inorganic fine powder refers to an average particle size calculated as $\Sigma nd/\Sigma n$ based on the number-basis particle size distribution of the inorganic fine powder measured in a manner as described hereinafter.

If the length-average particle size of the inorganic fine powder is below 0.1 μm, it is too small so that the inorganic fine powder shows too strong adherence onto the magnetic toner surface and the separation of the powder from the magnetic toner surface cannot be readily caused, thus failing to exhibit the effect of the present invention. If the inorganic fine powder has a length-average particle size exceeding 5 μm, the inorganic fine powder shows a poor mixability with the magnetic toner, thus being liable to scatter from the sleeve surface to soil the charging wire of the corona charger or cause a decrease in image density. Further, inorganic fine powder having a high rigidity and also a large particle size is liable to damage the surface of the photosensitive member as a latent image-bearing member, thus being undesirable.

If the inorganic fine powder is added in an amount of below 0.5 wt. %, the formation of the inorganic fine powder layer on the developing sleeve is insufficient, so that it is difficult to exhibit the effect of the present invention. On the other hand, if the amount exceeds 10 wt. %, the inorganic fine powder layer on the developing sleeve becomes too thick, so that the triboelectric charging between the magnetic toner and the developing sleeve is hindered to result in poor images having low image densities.

It is preferred that the inorganic fine powder shows a triboelectric charge in the range of 0.1–10 μC/g (absolute value) when measured after being blended in a proportion of 5 wt. % with 95 wt. % of iron powder (e.g., "EFV 200/300" available from Powdertec K.K.) and separated under suction (at about 200 $mmH_2O$) through a 500 mesh-stainless steel filter.

Good results are obtained through formation of a suitable degree of the inorganic fine powder layer on the developing sleeve surface, if the magnetic toner used in the present invention, when measured in mixture with the inorganic fine powder, contains 5–18% by number, preferably 7–15% by number, of particles having particle sizes of 4 μm or smaller. Below 5% by number, the inorganic fine powder is insufficient in amount, so that the layer formation of the inorganic fine powder becomes insufficient on the developing sleeve surface. On the other hand, in excess of 18% by number, the amount of magnetic toner particles having a particle size of 4 μm or smaller becomes remarkably large, so that the fine powder of magnetic toner forms a layer on the developing sleeve surface to suppress the formation of the inorganic fine powder layer. As a result, when a developing operation is successively performed for such a long period and a large number of sheets as to change the surface characteristic of the developing sleeve, the magnetic toner causes sticking onto the developing sleeve. Further, magnetic toner particles having particle size of 4 μm or smaller present in a large amount are liable to be attached even onto a region of the latent image-bearing member having no electrostatic images at the time of development to cause background fog, thus being undesirable.

Figure 1:
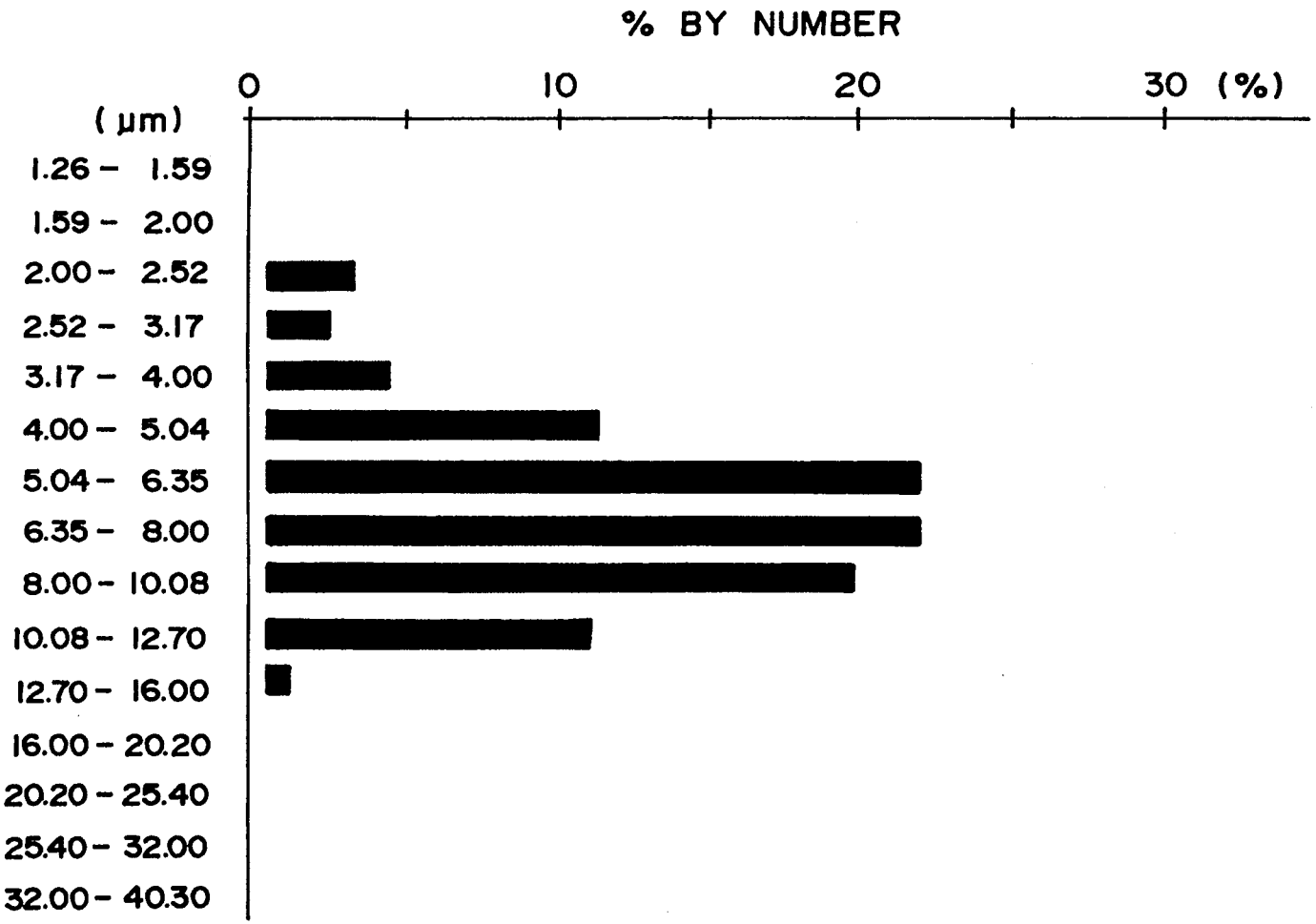
FIG. 1 is a graph showing the number-basis particle size distribution of a monocomponent-type developer of Example 1.

Particularly excellent results are attained if the monocomponent-type developer contains particles of 4 μm or smaller including a larger proportion in a range (channel) of 2–2.52 μm than in a range (channel) of 2.52–3.17 μm in terms of a number-basis particle size distribution as shown in FIG. 1. When such a distribution is satisfied, a proper degree of the inorganic fine powder layer is formed on the developing sleeve surface even in a normal temperature-very low humidity environment, thus being able to retain a high image density and good image characteristics. In a normal temperature-very low humidity environment, the magnetic toner is caused to have a large charge, so that the formation of the inorganic fine powder layer is more remarkably hindered by fine powdery toner particles in the magnetic toner. However, as a monocomponent-type developer containing a larger proportion in the range of 2–2.52 μm than in the range of 2.52–3.17 μm is obtained by removing fine powdery magnetic toner particles hindering the formation of the inorganic fine powder layer and adding the inorganic fine powder, the formation of the inorganic fine powder layer on the developing sleeve is not hindered by fine powder of the magnetic toner even in a normal temperature-very low humidity environment.

It is desirable that the monocomponent-type developer in the form of a mixture of the magnetic toner and the inorganic fine powder has a particle size distribution including 1–10% by number, preferably 2–7% by number, of particles of 2.00–2.52 μm, 0.5–8% by number, preferably 1–6% by number, of particles of 2.52–3.17 μm, and 2–15% by number, preferably 3–10% by number, of particles of 3.17–4.00 μm pitch the proviso that the particles of 2.00–2.52 μm is present in a larger proportion than the particles of 2.52–3.17 μm.

The monocomponent-type developer according to the present invention contains at least 60% by number of particles of 4ϕ–10 μm and is provided with an improved chargeability on the developing sleeve by addition of the inorganic fine powder. A magnetic toner having a high charge is caused to effectively jump from the developing sleeve onto the latent image-bearing member under the action of a developing bias at a duty ratio of below 50% to faithfully attach to an electrostatic latent image to effect development, thus providing a high quality image. However, if the particles of 4–10 μm is less than 60% by number, the development of an electrostatic latent image becomes insufficient to provide a rather low image density. Magnetic toner particles of 10 μm or larger are provided with a lower charge, so that it becomes difficult to faithfully develop electrostatic latent images. Further, magnetic toner particles of 4–10 μm are consumed at a higher proportion and, as the continuation of a successive developing operation for a long period, particles outside the range of 4–10 μm are gradually accumulated to change the particle size distribution of the magnetic toner on the developing sleeve, thus being liable to cause problems, such as background fog and decrease in image density.

Particularly, in terms of volume-basis particle size distribution, if particles of 12.7 μm or larger are contained in a proportion exceeding 10 vol. %, this means that particles having a low charge which are not desirable for development using a developing bias having a duty ratio of below 50% are present in a large proportion, to result in a low image density and inferior image reproducibility. Accordingly, in the monocomponent-type developer according to the present invention, particles of 12.7 m or larger should be suppressed to at most 10 vol. % based on a volume-basis particle size distribution and, if this range is satisfied, good results are attained even in a long period of successive image formation providing a large number of sheets.

The monocomponent-type developer according to the present invention has a weight-average particle size of 7–11 μm, preferably 7.5–10.5 μm. While the weight-average particle size requirement cannot be considered separately from the other requirements, a weight-average particle size of below 7 μm means an increased proportion of relatively fine particles and is liable to result in background fog and a rather low image density in an environment of normal temperature-very low humidity (e.g., 23° C., 5% RH). On the other hand, if the weight-average particle size exceeds 11 μm, rather coarse particles are relatively rich in the magnetic toner, to result in a decrease in image density and a lowering in image characteristics in a long term of successive image formation or in a high humidity environment.

If the monocomponent-type developer of the present invention is applied to an image forming method using a development bias of asymmetric character as described above, the effects of the monocomponent-type developer of the present invention are more effectively exhibited.

The particle size distribution of a toner and a developer may be measured by means of a Coulter counter in the present invention, while it may be measured in various manners.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.) are connected.

For measurement, a 1%-NaCl aqueous solution as an electrolyte solution is prepared by using a reagent-grade sodium chloride. For example, ISOTON®-II (available from Coulter Scientific Japan K.K.) may be used therefor. Into 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 micron-aperture to obtain a volume-basis distribution and a number-basis distribution. From the results of the volume-basis distribution and number-basis distribution, parameters characterizing the magnetic toner and developer of the present invention may be obtained.

The length-average particle size ($\Sigma nd/\Sigma n$, D=particle size) of inorganic fine powder referred to herein is based on measurement of particle size distribution using a Coulter counter. The measurement may be performed in a similar manner as the measurement of a toner particle size distribution as described. In the actual measurement, an electrolyte containing a sample suspended therein was subjected to dispersion for 5 minutes by an ultrasonic disperser, followed by measurement of a number-basis particle size distribution in the range of 0–40 μm to calculate a length-average particle size.

The Counter counter should be equipped with an appropriate size of aperture so as to effect an accurate measurement of the length-average particle size of the inorganic fine powder within an extent not causing plugging of the aperture. More specifically, in case where coarse particles of 6 μm or larger are absent, it is preferred to use an aperture of 15 μm. In case where particles of 6–20 μm are present and particles exceeding 20 μm are not present, it is preferred to use an aperture of 50 μm. In case where particles of 20–40 μm are present and particles exceeding 40 μm are absent, it is preferred to use an aperture of 100 μm.

The inorganic fine powder used in the developer of the present invention may for example comprise a fine powder of inorganic oxides and a fine powder of a carbonate. The inorganic oxides may include: oxides, such as zinc oxide, and tin oxide; and double oxides, such as strontium titanate, barium titanate, calcium titanate, strontium zirconate, and calcium zirconate. The carbonates may include calcium carbonate and magnesium carbonate. Among these, a fine powder of double oxide of titanium oxide, particularly strontium titanate, shows excellent effects.

The inorganic fine powder having a length-average particle size of 0.1–5 μm may preferably be hydrophilic and non-magnetic. The required degree of hydrophilicity may be satisfied if the fine powder can be wetted with water and dispersed in water.

In addition to the inorganic fine powder having a length-average particle size of 0.1–5 μm, it is preferred to externally add hydrophobic colloidal silica fine powder to the magnetic toner so as to improve the flowability and charge stability of the developer. The hydrophobic colloidal silica fine powder may preferably have a BET specific surface area of at least 100 $m^2/g$ and used in an amount of 0.05–5 wt. %, particularly 0.1–2 wt. %, based on the magnetic toner. The hydrophobic colloidal silica fine powder may preferably have a triboelectric chargeability of the same polarity as the magnetic toner so as to attach the surface of the magnetic tone particle surface and move together with the magnetic toner particles.

The hydrophobicity of hydrophobic colloidal silica fine powder referred to herein are based on values measured in the following manner while other methods may be applicable with reference to the following method.

100 ml of pure water and 1 g of a sample are placed in a vessel equipped with a closely fitted stopper and vibrated for 10 minutes on a vibrator. After the vibration, the container is left standing for several minutes to allow separation into a silica powder layer and an aqueous layer. The aqueous layer is then sampled, and the transmittance thereof at a wavelength of 500 nm is measured with reference to that of pure water free from contact with the silica fine powder. The relative transmittance value thus obtained is taken as the hydrophobicity of the sample silica fine powder.

The silica fine powder used in the present invention may preferably have a hydrophobicity of at least 60%, more preferably at least 70%.

The developer according to the present invention may further contain other additives according to necessity. Examples of such additives may include: lubricants, such as polytetrafluoroethylene (Teflon), polyvinylidene fluoride, and fatty acid metal salts; abrasives, such as cerium oxide, and silicon carbide; flowability-imparting agents or anti-caking agents, such as surface-treated titania and surface-treated alumina treated by surface-treating agents, such as silicone oil, various modified silicone oil, silane coupling agents, and silane coupling agents having functional groups; carbon black; and fixing acids, such as low-molecular weight polyethylene. More specifically, it is possible to add a waxy substance, such as low-molecular weight polyethylene, low-molecular weight polypropylene, microcrystalline wax, carnauba wax and sasol wax in an amount of 0.5–5 wt. % to the toner of the present invention in order to improve the releasability at the time of hot roller fixation.

The binder resin constituting the magnetic toner used in the present invention may for example comprise the following materials.

Homopolymers or copolymers of vinyl monomers shown below: sytrene; styrene derivatives, such as o-methylstyrene, m-methylstyrene, p-methylstyrene, p-methylstyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; vinyl compound derivatives having a carboxylic group, such as acrylic acid, methacrylic acid, maleic acid, and fumaric acid; half esters, such as maleic acid half esters, and fumaric acid half esters: maleic anhydride, maleic acid esters and fumaric acid ester derivatives.

Further examples of the binder resin may include: polyesters, polyurethane, epoxy resin, polyvinylbutyral, rosin, modified rosin, terpene resin, phenolic resin, aliphatic or alicyclic hydrocarbon resins, aromatic petioleum resins, haloparaffins, paraffin wax, etc. These may be used singly or in mixture.

Among these, styrene-type resins, acrylic resins, and polyester resins are particularly preferred as binder resins.

In view of the anti-offset characteristic of the resultant polymer, the binder resin may further preferably be a crosslinked vinyl polymer, a crosslinked vinyl copolymer or a mixture of these polymers, obtained by using a crosslinking agent as follows:

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic. It is preferred that at least one of these compounds is used for constituting the binder resin.

The binder resin for constituting a toner to be used for a pressure fixing system may comprise a low-molecular weight polyethylene, low-molecular weight polypropylene, ethylene-vinyl acetate copolymer, ethylene-acrylate copolymer, higher fatty acid, polyamide resin or polyester resin. These resins may be used singly or in mixture.

The magnetic toner according to the present invention comprises a magnetic material, examples of which may include: iron oxide and iron oxide containing another metal oxide, such as magnetite, maghemite, and ferrite; metals, such as Fe, Co and Ni, alloys of these metals with other metals, such as Al, Co, Cu, Pb, Mg, Ni, Sn, Zn, Sb, Be, Bi, Cd, Ca, Mn, Se, Ti, W and V, and mixtures of these materials.

The magnetic material may preferably have an average particle size of 0.1–2 μm, and magnetic properties under application of 10 k Oersted, inclusive of a coercive force of 20–150 Oersted, a saturation magnetization of 50–200 emu/g, particularly 50–100 emu/g, and a remanence of 2–20 emu/g.

The magnetic toner according to the present invention may preferably be used by adding a charge control agent internally or externally. The charge control agent may be known positive charge controllers, examples of which may include: nigrosine and its modified products, e.g., with aliphatic acid metal salts, quarternary ammonium salts, diorganotin oxides and diorganotin borates. These may be used singly or in combination of two or more species. Among these, nigrosine type compounds and quarternary ammonium salts may be particularly preferred.

Further, it is also possible to use as a positive charge control agent a homopolymer of a nitrogen-containing monomer represented by the formula:

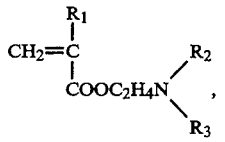

wherein $R_1$ denotes H or $CH_3$, and $R_2$ and $R_3$ respectively denote an alkyl group capable of having a substituent; or a copolymer of the nitrogen-containing monomer with another polymerizable monomer as described above, such as styrene, an acrylate or a methacrylate. The resultant nitrogen-containing homopolymer or copolymer can also function as a part or all of the binder resin.

Alternatively, in the present invention, it is also possible to use a negative charge control agent, which may be known one such as carboxylic acid derivatives or their metal salts, alkoxylates, organic metal complexes, and chelate compounds. These negative charge control agents may be used singly or in mixture of two or more species. Among these, acetylacetone metal complex, salicyclic acid metal complexes alkylsalicylic acid metal complexes, dialkylsalicyclic acid metal complexes, naphthoic acid metal complexes, and monoazometal complexes may be particularly suitably used.

The toner according to the invention can contain an arbitrary appropriate pigment or dye as a colorant as desired. The magnetic material may also function as a colorant.

The magnetic toner used in the present invention may preferably be prepared by a method in which toner constituents are sufficiently blended in a mixer such as a ball mill and then kneaded well in a hot kneading means, such as a kneader or extruder, mechanically crushed and classified. Alternatively, it is possible to use a method wherein a binder resin solution containing other components dispersed therein is spray-dried; a polymerization method wherein prescribed ingredients are dispersed in a monomer constituting a binder resin and the mixture is emulsified, followed by polymerization of the monomer to provide a polymer; etc. The toner used in the present invention can be in the form of a microcapsule toner comprising a core material and a shell material.

In the present invention, it is particularly preferred to use as a latent image-bearing member a photosensitive member comprising an a-Si photosensitive layer on a conductive substrate in applying the bias conditions according to the present invention.

Such an a-Si photosensitive member can be provided with a lower charge injection-prevention roller below the photosensitive layer so as to prevent charge injection from the substrate.

It is further possible to provide a surface protective layer above the photosensitive layer in order to improve the durability and provide an upper charge injection-preventing layer above the photosensitive layer or between the surface protective layer and the photosensitive layer.

It is also possible to dispose a layer which functions as both a surface protective layer and an upper charge injection-preventing layer.

It is also possible to dispose a long-wavelength light-absorbing layer above or below the lower charge injection-preventing layer in order to prevent interference with long-wavelength light.

In this instance, so as to adapt the respective layers to their practical use, it is possible to introduce various atoms inclusive of: hydrogen atom; Group III atoms of the periodic table, such as boron, aluminum, and gallium; Group IV atoms of the periodic table, such as germanium and tin; Group V atoms of the periodic table, such as nitrogen, phosphorus and arsenic; Group VI atoms of the periodic table, such as oxygen, sulfur, and selenium; and halogen atoms, such as fluorine, chlorine, and bromine, along or in combination at the time of formation of a-Si.

For example, a photosensitive drum for holding a negatively charged electrostatic image can be prepared by forming a photosensitive layer with hydrogenated (i.e., hydrogen-containing) a-Si, a lower charge injection-preventing layer with hydrogenated a-Si doped with phosphorus, and an upper charge injection-preventing layer with hydrogenated a-Si doped with boron.

On the other hand, a photosensitive drum for holding a positively charged electrostatic image can be prepared by forming a lower charge injection-preventing layer with hydrogenated a-Si doped with boron and a surface protective layer with an amorphous film comprising silicon, carbon and hydrogen (hereinafter called a-SiC film).

An a-Si photosensitive member is generally excellent in heat resistance and abrasion resistance and is thus excellent in durability. Accordingly, the image forming method according to the present invention is advantageous for realization of a high-speed image forming apparatus. Further, it is possible to form a latent image faithful to an original image so that it is advantageous in realizing a high image quality in an image forming apparatus such as a copying machine.

An Se photosensitive member and an OPC photosensitive member can cause deterioration of the photosensitive layer during a continuous use due to white reflection light, laser light and mechanical action to result in difficulties, such as decrease in photoconductivity and chargeability and increase in dark decay, so that they can fail to show sufficient electrophotographic performances in some cases. In such cases, there can arise difficulties such that a sufficient dark potential can not be attained, it becomes impossible to lower the light part potential to a necessary level, and it becomes difficult to obtain an appropriate potential contrast or a latent image potential corresponding to an original. As a result, an insufficient density, fog and loss of gradation can occur. The deterioration is accelerated if a larger number of image forming cycles are repeated in a unit period of time, so that the above difficulties are pronounced in a high-speed machine. Accordingly, in order to obtain stable electrostatic latent images, an a-Si photosensitive member capable of always maintaining a constant latent image potential is advantageous and such as a-Si photosensitive member can be applied to a high-speed machine without problem.

Further, an Se photosensitive member and an OPC photosensitive member can cause a disturbance in thin or fine latent images for the above-mentioned reason. The magnetic toner used in the present invention is capable of faithfully develop even thin latent images so that such a disturbance in latent image can be reflected in a developed image, thus being disadvantageous in delicate expression of thin lines and dots. On the other hand, an a-Si photosensitive member does not cause a disturbance in latent image so that the above-mentioned problems are not caused. The problems are also pronounced at a higher process speed. The magnetic toner used in the present invention has a large specific surface area, so that it has a tendency to cause a frequency contact to accelerate the abrasion of the photosensitive member when applied to a high-speed machine. Se and OPC photosensitive members are particularly liable to be abraded to promote the problem. However, an a-Si photosensitive member has a high hardness so that it is not concerned with such a problem.

In the present invention, by controlling not only the magnitude but also the duration t of an AC bias electric field, a portion of the magnetic toner capable of faithfully developing a latent image on an a-Si photosensitive member is effectively flied to accomplish the object of present invention in a satisfactory manner.

More specifically, in the present invention, an AC bias voltage is controlled so that the magnitude of the developing-side bias electric field is increased and the duration thereof is shortened without charging the entire frequency of the AC bias voltage. Corresponding thereto, the reverse development-side bias electric field is suppressed to be low and the duration thereof is increased, whereby the duty ratio of the AC bias voltage is controlled.

By sufficiently increasing the development-side bias electric field according to the above control scheme, toner particles of 4–10 μm on the sleeve which constitute an essential component for providing an improved image quality are effectively flied reciprocally to fully develop a latent image on an a-Si photosensitive member and prevent the sticking thereof onto the sleeve surface, whereby the decrease in image density and developer-carrying member memory are suppressed.

Further, while the reverse-development side electric field is suppressed to be low, the duration thereof is sufficiently prolonged, so that an excess of toner attached to outside a latent image pattern on an a-Si photosensitive member is supplied with a peeling force from the latent image-bearing member 1 to suppress the ground fog.

At this time, the reverse development-side electric field is suppressed to be low, so that toner particles of 4–10 μm constituting an essential component for toner coverage are not peeled.

While the reverse development-side bias electric field is suppressed to be low, the duration thereof is made longer, so that the effecting peeling force from the latent image-bearing member is ensured. However, the toner image attached to a latent image pattern is not disturbed, whereby a good image quality with gradation can be realized.

According to the present invention, the development-side bias electric field of an AC bias voltage is intensified to fly a portion of the toner present in the vicinity of the sleeve, so that such a portion of the toner in the vicinity of the sleeve and having a large charge is more intensively attached to a latent image pattern. As a result, even to a weak latent image pattern on an a-Si photosensitive member, such a portion of the toner having a large charge is attached because of a large electrostatic force, whereby an image having an edge sharpness and a good resolution can be obtained, and magnetic toner particles of 4–10 μm which are an effective component for realizing a high image quality are effectively utilized to provide an extremely good image quality.

A latent image on an a-Si photosensitive member has a low surface potential but has a large capacitance, so that the charge thereof is large. Accordingly, the magnetic toner according to the present invention is small in particle size and has a large charge, so that it is firmly attached to the latent image. The toner thus attached to a latent image part having a potential to be developed (image part) is not affected by the exterior and the image thereof is not disturbed.

As for a non-image part, a fog toner (attached to such a non-image part) can be peeled by the developing bias according to the present invention even on an a-Si photosensitive member. As for a latent image on an a-Si photosensitive member, the magnetic toner is effectively flied under application of the above-mentioned specific bias voltage, so that a high image quality can be stably attached for a long period and the image quality is stable even under a continual use in a high-speed machine.

In the case where an a-Si photosensitive member is used as the latent image-bearing member, the above-mentioned effect of the present invention can be remarkably exhibited if the development is performed under a small difference between the light part potential and the dark part potential of 130–350 V, preferably 150–300 V.

Then, a developing sleeve used in a preferred embodiment of the present invention will be explained.

In the present invention, the developing sleeve may preferably have a surface unevenness comprising sphere-traced concavities. The surface state can be obtained by blasting with definite shaped particles. Herein, the definite-shaped particles may preferably be spherical or spheroidal particles having a substantially smoothly curved surface and having a ratio of longer axis/shorter axis of 1–2, preferably 1–1.5, further preferably 1–1.2. The definite-shaped particles may for example be various solid spheres or globules, such as those of metals such as stainless steel, aluminum, steel, nickel and bronze, or those of ceramic, plastic or glass beads, respectively, having a specific particle size.

A developing sleeve preferably used in the present invention may also be obtained by blasting first with indefinite-shaped particles and then with definite-shaped particles. Such indefinite-shaped particles may comprise arbitrary abrasives.

By blasting the sleeve surface with definite-shaped particles having a specific particle size, it is possible to form a plurality of sphere-traced concavities having almost the same diameter.

In the present invention, "thin-line reproducibility" was evaluated in the following manner. An original of a thin line image having a width of accurately 100 μm is copied under suitable copying conditions to provide a sample copy for measurement. The line width of the toner image on the copy is measured on a monitor of Luzex 450 Particle Analyzer. The line width is measured at several points along the length of the thin line toner image so as to provide an appropriate average value in view of fluctuations in width. The value of thin line reproducibility (%) is calculated by the following formula:

$$\frac{\text{Measured line-width of a copy image}}{\text{Line width (100 } \mu\text{m) on the original}} \times 100$$

In the present invention, the resolution was evaluated in the following manner. An original sheet having 10 original line images each comprising 5 lines spaced from each other with an identical value for line width and spacing is provided. The 10 original images comprise the 5 lines at pitches of 2.8, 3.2, 3.6, 4.0, 4.5, 5.0, 5.6, 6.3, 7.1, 8.0. 9.0 and 10.0 lines/mm, respectively. The original sheet is copied under suitable conditions to obtain a sample copy on which each of the ten line images is observed through a magnifying glass and the maximum number of lines (lines/mm) of an image in which the lines can be discriminated from each other is identified as a resolution measured. A larger number indicates a higher resolution.

Hereinbelow, the present invention will be explained in more detail based on Examples. Hereinbelow, "part(s)" used for describing a formation or composition are by weight.

EXAMPLE 1

Production of magnetic toner

| | |
|---|---|
| Styrene/butyl acrylate/monobutyl maleate/divinylbenzene copolymer (monomer wt. ratio = 67.7/25/7/0.3, Mw (weight-average molecular weight) = $38 \times 10^4$ | 100 parts |
| Magnetic powder (number-average particle size = 0.18 μm; saturation magnetization = 85 emu/g, residual magnetization = 12.5 emu/g and coercive force = 130 Oersted, as measured under an external magnetic field of $10^4$ Oersted) | 90 parts |
| Low-molecular weight butylene/propylene copolymer | 3 parts |
| 3,5-Di-tert-butylsalicylic acid Cr complex (charge control agent) | 2 parts |

The above ingredients were well blended in a blender and melt-kneaded at 130° C. by means of a twin-screw extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfg. Co. Ltd.) to obtain a classified powder product. Ultra-fine powder of 4 μm or smaller and coarse power were simultaneously and precisely removed from the classified powder by means of a multi-division classifier utilizing a Coanda effect (Elbow Jet Classifier available from Nittetsu Kogyo K.K.), thereby to obtain a negatively chargeable magnetic toner.

The thus-obtained magnetic toner was mixed with 3 wt. % of hydrophilic strontium titanate (as inorganic fine powder) having a length-average particle size of 2.25 μm and 0.5 wt. % of negatively chargeable hydrophobic dry-process colloidal silica (BET specific surface area=250 $m^2g$, hydrophobicity=85%) by means of a mixed to prepare a monocomponent-type developer. The particle size distribution of the monocomponent-type developer is shown in FIG. 1.

The triboelectric chargeability of the hydrophilic strontium titanate fine powder was measured by accurately weighing 0.5 g of the fine powder sample after standing overnight in an environment of 23.5° C. and 60% RH and 9.8 g of uncoated carrier iron powder ("EFV 200/300" available from Powdertec K.K.) having a mode particle size in the range of 200–300 mesh and mixing both powders within an about 50 cc-polyethylene-made wide-mouthed bottle covered with a lid sufficiently (by shaking the bottle 50 times up and down within about 20 sec), followed by measurement by the blow-off method. The measured value is shown in Table 1 appearing hereinafter.

Production of a developing sleeve

A stainless steel sleeve (SUS 304) in the form of a 32 mm-dia. cylinder containing a magnet therein was provided, and the surface thereof was blasted with spherical glass beads of #300 (53–62 μm) under the conditions of a blast nozzle diameter of 7 mm, a distance of 150 mm between the nozzle and the sleeve, an air pressure of 3.5 $kg/cm^2$ and a blasting time of 60 sec.

Production of a-Si photosensitive drum

An a-Si photosensitive drum was prepared by means of a high-frequency plasma CVD apparatus by using a gaseous mixture principally consisting of $SiH_4$, $H_2$, $CH_4$, $PH_3$, $B_2H_6$ and $GeH_4$ according to the glow discharge process.

An aluminum cylinder substrate of 108 mm diameter and 360 mm length was provided with a lower charge injection-preventing layer of hydrogenated a-Si doped with boron, then with a 25 μm-thick photosensitive layer of hydrogenated a-Si and with an uppermost surface protective layer of hydrogenated a-SiC, whereby an a-Si photosensitive drum was prepared.

The above prepared a-Si photosensitive drum was incorporated in an image forming apparatus as shown in FIG. 3 described below for image formation according to the present invention.

Referring to FIG. 1, the above-prepared a-Si photosensitive drum was used as the latent image-bearing member 1, the gap $\alpha$ between the latent image-bearing member 1 and the above-prepared developing sleeve 22 having a blasted surface was set at 0.25 mm, and the gap between the developing sleeve 22 and the magnetic doctor blade 24 was set at 0.24 mm to form a magnetic toner layer thickness of about 100 μm on the developing sleeve 22. The magnetic field given by the magnet roller 23 as measured on the sleeve surface was 1000 gauss at the $N_1$ pole, 1000 gauss at the $S_1$ pole, 750 gauss at the $N_2$ pole and 550 gauss at the $S_2$ pole.

Figure 5:
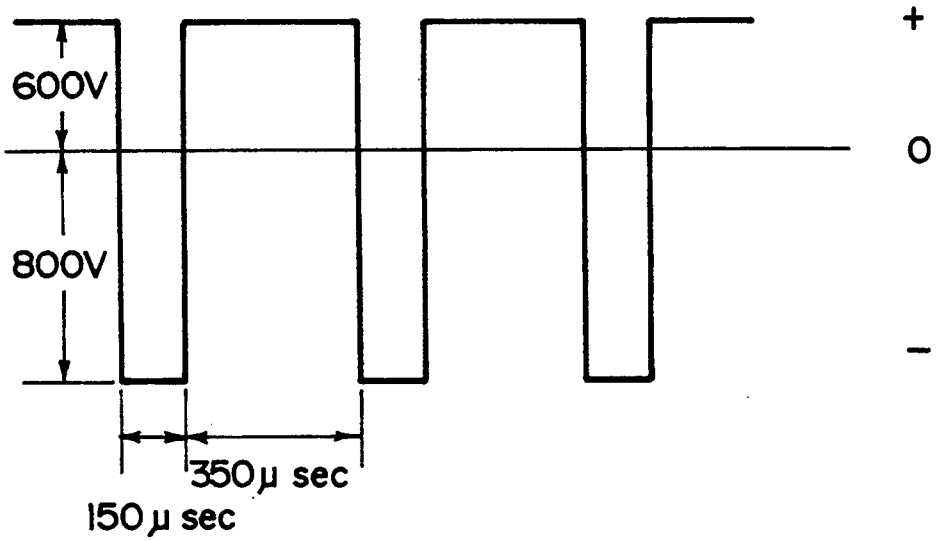
FIG. 5 is a waveform diagram showing an alternating bias voltage waveform used in Example 1.

A copying test was performed at a rate of 85 sheets (A4)/min, while supplying a sample developer intermittently into a hopper 21. In the test, an electrostatic latent image having a dark-part potential of 350 V and a light-part potential of 50 V was found on the a-Si photosensitive drum 1, the photosensitive drum 1 was rotated at a speed of 400 mm/sec and the developing sleeve 22 was rotated at a speed of 520 mm/sec, while applying a developing bias voltage between the photosensitive drum 1 and the developing sleeve 22. The developing bias used was a superposition of an AC voltage having a duty ratio of 30% and a DC voltage (180 V) as shown in FIG. 5.

Under normal temperature–normal humidity conditions (23.5° C., 60% RH), a continuous copying test of 106 sheets was performed. In the initial stage, there were obtained images with excellent qualities having an image density of 1.45, a thin-like reproducibility of 104%, a resolution of 8.0 lines/mm, and a background fog of 0.7%. After $5\times10^5$ sheets of continuous copying, the developing sleeve began to decrease its surface unevenness given by blasting, but no changes in image quality were observed. Further, the copying operation was continued up to $10^6$ sheets. As a result, the unevenness of the developing sleeve was worn to provide a smooth unevenness, but there were continually obtained images with substantially equal image qualities as in the initial stage including an image density of 1.43, a thin-line reproducibility of 102%, a resolution of 8 lines/mm, and a background fog of 0.6%.

Similarly good results were obtained under high temperature-high humidity (30° C.-85% RH) conditions.

Further, a similar continuous copying test was performed also under normal temperature-very low humidity conditions (23° C.-5% RH). In the initial stage, there were obtained images having an image density of 1.36, a thin-line reproducibility of 101%, a resolution of 8 lines/mm, and a background fog of 1.4%, thus with little background fog. After $10^6$ sheets of continuous copying, the developing sleeve surface showed a smooth unevenness and there were provided images having slightly lowered image qualities including an image density of 1.32, a thin-line reproducibility of 97%, a resolution of 7.1 lines/mm, and a background fog of 1.3%.

The background fog was evaluated by measuring the reflectance of a background portion of a sample image formed on a standard white paper by using a reflectometer ("REFLECTOMETER MODEL TC-6DS", available from Tokyo Denshoku K.K.) according to the reflectance mode using a green filter and by calculation according to the following formula. A smaller value represents less background fog.

Background fog (reflectance)(%)=reflectance of a standard white paper−reflectance of a background portion of a sample image formed on the standard white paper.

COMPARATIVE EXAMPLE 1

Figure 2:
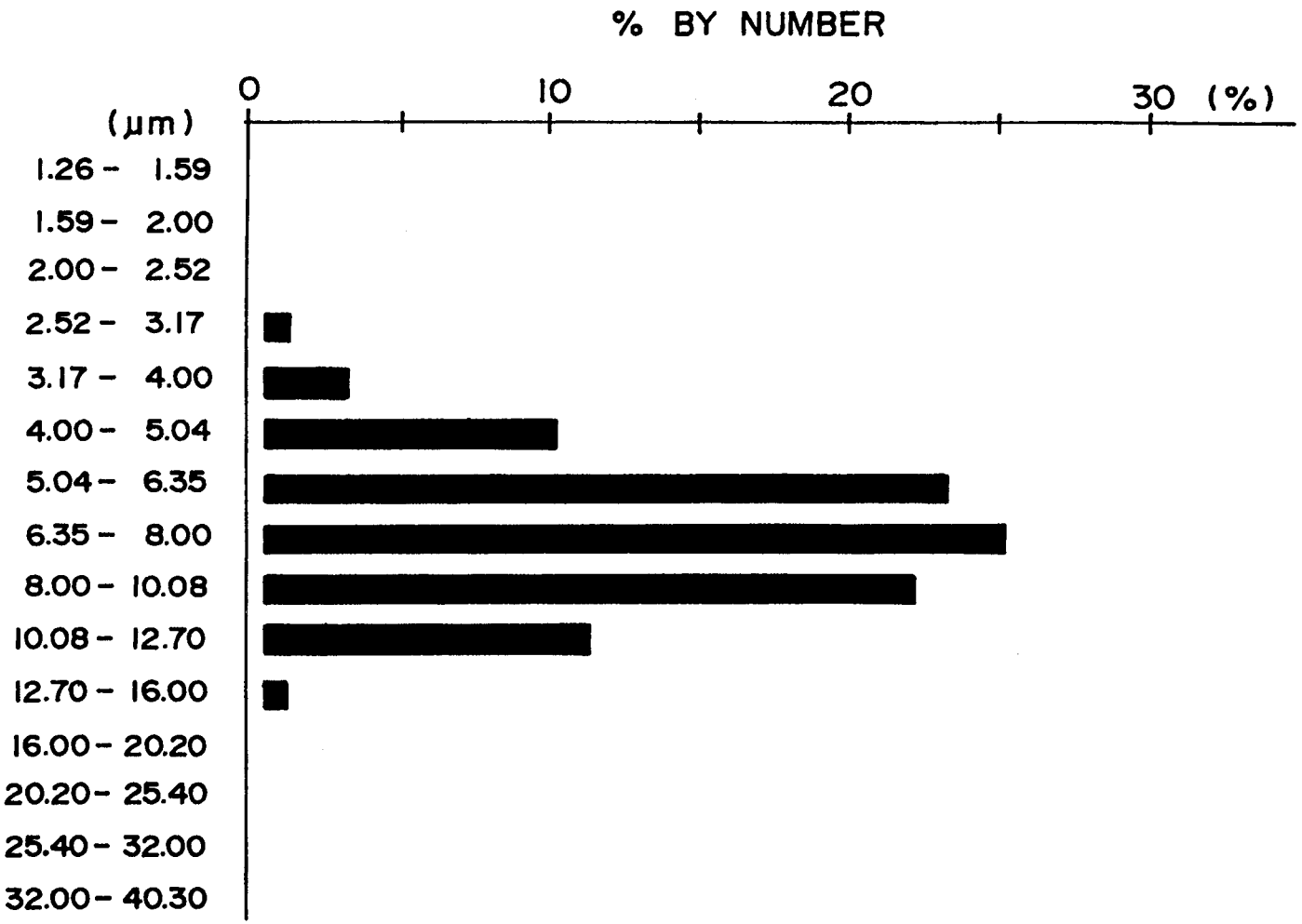
FIG. 2 is a graph showing the number-basis particle size distribution of a monocomponent-type developer of Comparative Example 1.

A developer was prepared in the same manner as in Example 1 except that the strontium titanate having a length-average diameter of 2.25 μm was omitted. The particle size distribution of the developer thus obtained is shown in FIG. 2. The developer was subjected to continuous copying tests in the same manner as in Example 1.

Under the normal temperature-normal humidity conditions, in the initial stage, there were obtained images of similar image qualities as in Example 1, including an image density of 1.33, a thin-line reproducibility of 102%, a resolution of 8 liens/mm and a background fog of 1.8%. However, from after $5\times10^5$ sheets of continuous copying, the image density began to be lowered gradually and slowly, and the background fog also began to increase while it was slightly. After $10^6$ sheets of copying when the developing sleeve surface showed a smooth unevenness, the image qualities were lowered down to an image density of 1.18, a thin-line reproducibility of 82%, a resolution of 4.5 lines/mm, and a background fog of 2.6%.

Under the normal temperature-very low humidity conditions, the image qualities included an image density of 1.23, a thin-line reproducibility of 88%, a resolution of 5.6 lines/mm and a background fog of 2.5%, which were inferior to the results in Example 1. Further, as a result of continuous copying test, from after $5\times10^5$ sheets, fine powder of the magnetic toner began to stick onto the developing sleeve surface and also a developer coating irregularity occurred on the developing sleeve. The resultant image qualities included an image density of 1.14, a thin-line reproducibility of 76%, a resolution of 4.5 lines/mm, and a background of 3.5%, which were remarkably inferior to the results in Example 1.

EXAMPLES 2–5

Developers were prepared in a similar manner as in Example 1 except for the matters specifically mentioned in Table 1 and subjected to continuous copying tests in the same manner as in Example 1.

The results under the normal temperature-normal humidity conditions (23.5° C.-60% RH) are shown in Table 2, and the results under the normal temperature-very low humidity conditions (23° C.-5% RH) are shown in Table 3.

COMPARATIVE EXAMPLE 2

A monocomponent-type developer was prepared in the same manner as in Example 1 except that hydrophilic strontium titanate having a length-average particle size of 2.25 μm was used in an amount of 0.3 wt. %. The particle size distribution data of the developer are shown in Table 1, and the results of continuous image formation tests are shown in Tables 2 and 3.

COMPARATIVE EXAMPLE 3

A monocomponent-type developer was prepared in the same manner as in Example 1 except that hydrophilic strontium titanate having a length-average particle size of 2.25 μm was used in an amount of 11 wt. %. The particle size distribution data of the developer are shown in Table 1, and the results of continuous image formation tests are shown in Tables 2 and 3.

COMPARATIVE EXAMPLE 4

A monocomponent-type developer was prepared in the same manner as in Example 1 except that hydrophilic strontium titanate having a length-average particle size of 0.35 μm was used in an amount of 3 wt. %. The particle size distribution data of the developer are shown in Table 1, and the results of continuous image formation tests are shown in Tables 2 and 3.

COMPARATIVE EXAMPLE 5

A monocomponent-type developer was prepared in the same manner as in Example 1 except that hydrophilic strontium titanate having a length-average particle size of 6.7 μm was used in an amount of 3 wt. %. The particle size distribution data of the developer are shown in Table 1, and the results of continuous image formation tests are shown in Tables 2 and 3.

COMPARATIVE EXAMPLE 6

A monocomponent-type developer having a weight-average particle size of 14 μm was prepared in a similar manner as in Example 1. The magnetic toner was mixed with 3 wt. % of hydrophilic strontium titanate having a length-average particle size of 2.25 μm and 0.5 wt. % of negatively chargeable hydrophobic dry-process colloidal silica (BET specific surface area=250 $m^2/g$, hydrophobicity=85%) to prepare a monocomponent-type developer. The particle size distribution data of the developer are shown in Table 1, and the results of continuous image formation tests are shown in Tables 2 and 3.

COMPARATIVE EXAMPLE 7

A monocomponent-type developer having a weight-average particle size of 5 μm was prepared in a similar manner as in Example 1. The magnetic toner was mixed with 3 wt. % of hydrophilic strontium titanate having a length-average particle size of 2.25 μm and 0.5 wt. % of negatively chargeable hydrophobic dry-process colloidal silica (BET specific surface area=250 $m^2/g$, hydrophobicity=85%) to prepare a monocomponent-type developer. The particle size distribution data of the developer are shown in Table 1, and the results of continuous image formation tests are shown in Tables 2 and 3.

TABLE 1

| | Inorganic fine powder | | | | Particle size distribution of monocomponent developer | | | | | | |
|---|---|---|---|---|---|---|---|---|---|---|---|
| | | | | | % by number | | | | | | |
| | Species* | Length-ave particle size (μm) | Tribo-electric charge (μC/g) | Amount (wt. %) | 2.00–2.52 μm | 2.52–3.17 μm | 3.17–4.00 μm | ≦4 um | 4–10 μm | % by volume ≧12.7 μm | Weight average size (μm) |
| Ex. 1 | H.S.T. | 2.25 | 3.2 | 3.0 | 3.6 | 2.5 | 4.1 | 10.2 | 77.3 | 8.1 | 9.3 |
| 2 | H.S.T. | 1.64 | 2.8 | 4.5 | 4.7 | 3.4 | 4.3 | 12.8 | 82.1 | 6.5 | 8.7 |
| 3 | H.S.T. | 0.87 | 4.4 | 2.0 | 2.3 | 1.8 | 3.2 | 7.3 | 85.4 | 4.3 | 8.4 |
| 4 | H.S.T. | 2.76 | 3.0 | 5.0 | 5.2 | 3.8 | 4.6 | 13.6 | 75.8 | 8.5 | 9.6 |
| 5 | H.B.T. | 0.53 | 0.5 | 1.0 | 1.8 | 1.5 | 3.1 | 6.4 | 91.6 | 2.6 | 7.9 |
| 6 | H.C.C. | 2.89 | 0.7 | 7.0 | 5.4 | 4.3 | 5.8 | 15.5 | 71.7 | 9.2 | 10.5 |
| Comp. Ex. 1 | — | — | — | — | 0.5 | 1.3 | 3.0 | 4.8 | 81.1 | 8.3 | 9.3 |
| 2 | H.S.T. | 2.25 | 3.2 | 0.3 | 3.4 | 2.5 | 4.1 | 10.0 | 77.2 | 8.1 | 9.3 |
| 3 | H.S.T. | 2.25 | 3.2 | 11 | 10.7 | 5.3 | 6.8 | 22.8 | 68.1 | 7.8 | 9.1 |
| 4 | H.S.T. | 0.35 | 5.8 | 3.0 | 0.9 | 1.3 | 3.0 | 5.2 | 81.3 | 8.2 | 9.3 |
| 5 | H.S.T. | 6.7 | 0.3 | 3.0 | 1.6 | 3.5 | 16.1 | 21.2 | 67.4 | 7.3 | 9.2 |
| 6 | H.S.T. | 2.25 | 3.2 | 3.0 | 3.2 | 2.1 | 3.5 | 8.8 | 53.4 | 51.5 | 14 |
| 7 | H.S.T. | 2.25 | 3.2 | 3.0 | 7.7 | 10.3 | 18.5 | 36.5 | 63.4 | 0.3 | 5 |

*H.S.T. = hydrophilic strontium titanate
H.B.T. = hydrophilic barium titanate
H.C.C. = hydrophilic calcium carbonate

TABLE 2

| | Image qualities evaluated by a continuous copying test of $10^6$ sheets under normal temperature-normal humidity conditions (23.5° C.–60% RH) | | | | | | | |
|---|---|---|---|---|---|---|---|---|
| | Initial stage | | | | After $10^6$ sheets | | | |
| | Image density | Thin-line reproducibility (%) | Resolution (lines/mm) | Background fog (%) | Image density | Thin-line reproducibility (%) | Resolution (lines/mm) | Background fog (%) |
| Ex. 1 | 1.45 | 104 | 8.0 | 0.7 | 1.43 | 102 | 8.0 | 0.6 |
| 2 | 1.43 | 103 | 7.1 | 0.9 | 1.46 | 106 | 8.0 | 0.7 |
| 3 | 1.46 | 105 | 8.0 | 0.6 | 1.44 | 103 | 7.1 | 0.5 |
| 4 | 1.42 | 102 | 7.1 | 1.0 | 1.43 | 103 | 7.1 | 0.8 |
| 5 | 1.34 | 101 | 9.0 | 1.4 | 1.35 | 94 | 6.3 | 1.1 |
| 6 | 1.32 | 107 | 6.3 | 1.5 | 1.31 | 112 | 5.6 | 1.3 |
| Comp. Ex. 1 | 1.33 | 102 | 8.0 | 1.8 | 1.18 | 82 | 4.5 | 2.6 |
| 2 | 1.05 | 73 | 2.8 | 3.2 | — | — | — | — |
| 3 | 1.32 | 103 | 6.3 | 1.5 | 1.23 | 93 | 5.6 | 2.1 |
| 4 | 1.13 | 85 | 5.0 | 1.8 | 1.08 | 78 | 4.5 | 2.6 |
| 5 | 1.31 | 102 | 6.3 | 1.7 | 1.25 | 86 | 4.5 | 2.8 |
| 6 | 1.31 | 103 | 6.3 | 0.8 | 1.18 | 85 | 5.0 | 0.7 |
| 7 | 1.31 | 101 | 8.0 | 3.5 | 1.21 | 98 | 7.1 | 4.1 |

TABLE 3

| | Image qualities evaluated by a continuous copying test of $10^6$ sheets under normal temperature-normal humidity conditions (23.5° C.–60% RH) | | | | | | | |
|---|---|---|---|---|---|---|---|---|
| | Initial stage | | | | After $10^6$ sheets | | | |
| | Image density | Thin-line reproducibility (%) | Resolution (lines/mm) | Background fog (%) | Image density | Thin-line reproducibility (%) | Resolution (lines/mm) | Background fog (%) |
| Ex. 1 | 1.36 | 101 | 8.0 | 1.4 | 1.32 | 97 | 7.1 | 1.3 |
| 2 | 1.33 | 100 | 7.1 | 1.5 | 1.34 | 101 | 7.1 | 1.4 |
| 3 | 1.31 | 102 | 8.0 | 1.2 | 1.33 | 99 | 7.1 | 1.0 |
| 4 | 1.35 | 102 | 6.3 | 1.3 | 1.36 | 103 | 6.3 | 1.1 |

TABLE 3-continued

| | Image qualities evaluated by a continuous copying test of $10^6$ sheets under normal temperature-normal humidity conditions (23.5° C.-60% RH) | | | | | | | |
|---|---|---|---|---|---|---|---|---|
| | Initial stage | | | | After $10^6$ sheets | | | |
| | Image density | Thin-line reproducibility (%) | Resolution (lines/mm) | Background fog (%) | Image density | Thin-line reproducibility (%) | Resolution (lines/mm) | Background fog (%) |
| 5 | 1.28 | 98 | 8.0 | 1.8 | 1.27 | 93 | 5.6 | 1.7 |
| 6 | 1.24 | 104 | 5.6 | 2.0 | 1.21 | 102 | 5.6 | 1.8 |
| Comp. Ex. 1 | 1.23 | 88 | 5.6 | 2.5 | 1.14 | 76 | 4.5 | 3.5 |
| 2 | 0.95 | 68 | 2.5 | 4.8 | — | — | — | — |
| 3 | 1.14 | 92 | 8.0 | 3.1 | 1.06 | 79 | 4.5 | 3.7 |
| 4 | 1.07 | 82 | 4.5 | 2.4 | 1.03 | 80 | 3.6 | 3.4 |
| 5 | 1.22 | 90 | 5.6 | 3.2 | 1.18 | 78 | 4.5 | 4.6 |
| 6 | 1.25 | 91 | 4.5 | 1.1 | 1.22 | 88 | 4.5 | 1.5 |
| 7 | 1.18 | 93 | 8.0 | 5.4 | 1.05 | 75 | 7.1 | 5.8 |

As is understood from the above description and experimental data, the monocomponent-type developer according to the present invention exhibit the following advantageous effects when applied to a developing system using an asymmetric developing bias.

(1) Showing continually excellent characteristics even in a long period of continuous image formation of $10^6$ sheets or even more while continually providing images with a high density and free from background fog.

(2) Providing high-quality images excellent in thin-line reproducibility and resolution even after a long period of continuous image formation.

(3) Providing images having a stably high image density, excellent in thin-line reproducibility and resolution, and free from background fog.

What is claimed is:

1. A monocomponent-type developer for developing electrostatic images, comprising: a magnetic toner containing at least a binder resin and magnetic powder, and 0.5–10 wt. % (based on the magnetic toner) of inorganic fine powder having a length-average particle size of 0.1–5 μm;

wherein the developer has a number-basis particle size distribution such that particles of 2.00–2.52 μm are contained in a larger proportion than particles of 2.52–3.17 μm, particles of 4 μm or smaller are contained at 5–18% by number and particles of 4–10 μm are contained at at least 60% by number;

the developer has a volume basis particle size distribution such that particles of 12.7 μm or larger are contained at at most 10% by volume; and the developer has a weight-average particle size of 7–11 μm.

2. The developer according to claim 1, wherein the inorganic fine powder has a length-average particle size of 0.5–3 μμm.

3. The developer according to claim 1, wherein the inorganic fine powder is contained at 1–7 wt. % (based on the magnetic toner).

4. The developer according to claim 1, wherein the inorganic fine powder has a length-average particle size of 0.5–3 μm and contained at 1–7 wt. % (based on the magnetic toner).

5. The developer according to claim 1, wherein the inorganic fine powder has a triboelectric chargeability of 0.1–10 μC/g in terms of an absolute value.

6. The developer according to claim 1, wherein the particles of 4 μm or smaller are contained at 7–15% by number.

7. The developer according to claim 1, wherein the particles of 2.00–2.52 μm are contained at 1–10% by number and in a larger proportion than the particles of 2.52–3.17 μm.

8. The developer according to claim 7, wherein the particles of 2.52–3.17 μm are contained at 0.5–8% by number.

9. The developer according to claim 7, wherein the particles of 2.00–2.52 μm are contained at 2–7% by number.

10. The developer according to claim 7, wherein the particles of 2.52–3.17 μm are contained at 1–6% by number.

11. The developer according to claim 11, wherein the particles of 3.17–4.00 μm are contained at 2–15% by number.

12. The developer according to claim 11, wherein the particles of 3.17–4.00 μm are contained at 3–10% number.

13. The developer according to claim 1, wherein the inorganic fine powder comprises hydrophilic nonmagnetic inorganic fine powder.

14. The developer according to claim 13, wherein the inorganic fine powder comprises fine powder of an inorganic oxide or an inorganic carbonate.

15. The developer according to claim 13, wherein the inorganic fine powder comprises fine powder of an inorganic substance selected from the group consisting of zinc oxide, tin oxide, strontium titanate, barium titanate, calcium titanate, strontium zirconate, calcium zirconate, calcium carbonate, and magnesium carbonate.

16. The developer according to claim 13, wherein the inorganic fine powder comprises strontium titanate.

17. The developer according to claim 1, wherein hydrophobic colloidal silica fine powder is further contained.

18. The developer according to claim 17, wherein the hydrophobic colloidal silica fine powder is contained at 0.05–5 wt. % (based on the magnetic toner).

19. The developer according to claim 17, wherein the hydrophobic colloidal silica fine powder is contained at 0.1–2 wt. % (based on the magnetic toner).

20. The developer according to claim 17, wherein the hydrophobic colloidal silica fine powder has a BET specific area of at least 100 $m^2/g$.

21. The developer according to claim 17, wherein the hydrophobic colloidal silica fine powder has a hydrophobicity of at least 60%.

22. The developer according to claim 17, wherein the hydrophobic colloidal silica fine powder has a hydrophobicity of at least 70%.

23. The developer according to claim 1, wherein the magnetic powder has an average particle size of 0.1–2 μm, and shows a coercive force of 20–150 oersted, a saturation magnetization of 50–200 emu/g and a residual magnetization of 2–20 emu/g when measured by application of 10 kilo-oersted.

24. The developer according to claim 23, wherein the magnetic powder has an average particle size of 0.1–0.5 μm and a saturation magnetization of 50–100 emu/g.

25. An image forming method, comprising:

disposing a latent image-bearing member for holding an electrostatic image thereon and a developer-carrying member for carrying a monocomponent-type developer with a prescribed gap at a developing station; the monocomponent-type developer comprising a magnetic toner containing at least a binder resin and magnetic powder, and 0.5–10 wt. % (based on the magnetic toner) of inorganic fine powder having a length-average particle size 0.1–5 μm; wherein the developer has a number-basis particle size distribution such that particles of 2.00–2.52 μm are contained in a larger proportion than particles of 2.52–3.17 μm, particles of 4 μm or smaller are contained at 5–18% by number and particles of 4–10 μm are contained at at least 60% by number; the developer has a volume basis particle size distribution such that particles of 12.7 μm or larger are contained at at most 10% by volume, and the developer has a weight-average particle size of 7–11 μm;

conveying the monocomponent-type developer in a layer carried on the developer-carrying member and regulated in a thickness thinner than the prescribed gap to the developing station; and applying an alternating bias voltage comprising a DC bias voltage and an asymmetrical AC bias voltage in superposition between the developer-carrying member and the latent image-bearing member at the developing station to provide an alternating bias electric field comprising a development-side voltage component and a reverse-development side voltage component, the development-side voltage component having a magnitude equal to or larger than that of the reverse development-side voltage component and a duration smaller than that of the reverse-development side voltage component, so that the developer on the developer-carrying member is transferred to the latent image-bearing member to develop the electrostatic image thereon at the developing station.

26. The image forming method according to claim 25, wherein the alternating bias electric field has a duty ratio of below 50% as defined by the following equation:

$$\text{Duty ratio} = t_a/(t_a+t_b)\ (\times 100)\ \%,$$

wherein $t_a$ denotes the duration of a voltage component with a polarity for directing the toner toward the latent image-bearing member (constituting the developing side bias component a), and $t_b$ reversely denotes the duration a voltage component with a polarity for peeling the toner from the latent image-bearing member (constituting the reverse development-side bias component b), respectively, within one cycle of the alternating bias electric field.

27. The image forming method according to claim 26, wherein the alternating bias electric field has a duty ratio of 20–45%.

28. The image forming method according to claim 26, wherein the alternating bias electric field has a duty ratio of 25–40%.

29. The image forming method according to claim 25, wherein the alternating bias electric field has a frequency of 1.0–3.0 kHz.

30. The image forming method according to claim 25, wherein the alternating bias electric field has a frequency of 1.5–2.5 kHz.

31. The image forming method according to claim 25, wherein the alternating bias electric field has a voltage of 0.5–3.0 kV (absolute value).

32. The image forming method according to claim 25, wherein the alternating bias electric field has a voltage of 1.0–2.0 kV (absolute value).

33. The image forming method according to claim 25, wherein the latent image-bearing member comprises an a-Si photosensitive member.

34. The image forming method according to claim 33, wherein the a-Si photosensitive member shows a difference between dark-part potential and light-part potential in the range of 130–350 V.

35. The image forming method according to claim 33, wherein the a-Si photosensitive member shows a difference between dark-part potential and light-part potential in the range of 150–300 V.

36. The image forming method according to claim 25, wherein the developer-carrying member comprises a developing sleeve having a surface unevenness formed by blasting with indefinite-shaped particles and blasting with definite-shaped particles.

37. The image forming method according to claim 25, wherein the monocomponent-type developer is a developer according to any one of claims 3–25.

* * * * *

UNITED STATES PATENT AND TRADEMARK OFFICE

CERTIFICATE OF CORRECTION

PATENT NO. : 5,348,829

DATED : September 20, 1994

INVENTOR(S) : MASAKI UCHIYAMA, ET AL.

It is certified that error appears in the above-identified patent and that said Letters Patent is hereby corrected as shown below:

COLUMN 4

Line 60, "calling" should read --receiving--.

COLUMN 8

Line 61, "in" should be deleted.

COLUMN 9

Line 46, "duration" should read --duration of--.
Line 57, "sleeve 23" should read --sleeve 22--.

COLUMN 10

Line 59, "be jumped" should read --jump--.

COLUMN 12

Line 36, "saw-teeth" should read --sawtooth--.

COLUMN 14

Line 49, "pitch" should read --with--.
Line 50, "is" should read --are--.
Line 54, "4ϕ-10 μm" should read --4-10 μm--.
Line 63, "is" should read --are--.

COLUMN 15

Line 17, "12.7 m" should read --12.7 μm--.

UNITED STATES PATENT AND TRADEMARK OFFICE

CERTIFICATE OF CORRECTION

PATENT NO. : 5,348,829

DATED : September 20, 1994

INVENTOR(S) : MASAKI UCHIYAMA, ET AL.

It is certified that error appears in the above-identified patent and that said Letters Patent is hereby corrected as shown below:

COLUMN 16

Line 16, "Counter" should read --Coulter--.
Line 20, "case" should read --the case--.
Line 25, "case" should read --the case--.
Line 56, "tone" should read --toner--.
Line 59, "are" should read --is--.

COLUMN 17

Line 33, "methylstyrene," should read --methoxystyrene,--.

COLUMN 18

Line 1, "peti-" should read --petr- --.

COLUMN 19

Line 14, "quarternary" should read --quaternary--.
Line 18, "quarternary" should read --quaternary--.
Line 41, "known" should read --a known--.
Line 46, "complexes" should read --complexes,--.

COLUMN 21

Line 11, "as" should read --an--.
Line 17, "develop" should read --developing--.
Line 37, "flied" should read --transported--.
Line 52, "flied" should read --transported--.

UNITED STATES PATENT AND TRADEMARK OFFICE

CERTIFICATE OF CORRECTION

PATENT NO. : 5,348,829

DATED : September 20, 1994

INVENTOR(S) : MASAKI UCHIYAMA, ET AL.

It is certified that error appears in the above-identified patent and that said Letters Patent is hereby corrected as shown below:

COLUMN 22

Line 10, "fly" should read --transport--.
Line 37, "flied" should read --transported--.
Line 49, "Then," should read --Next--.
Line 54, "definite shaped" should read --definite-shaped--.

COLUMN 23

Line 37, "formation" should read --formulation--.

COLUMN 24

Line 9, "mixed" should read --mixer--.
Line 16, "9.8 g" should read --9.5 g--.

COLUMN 25

Line 12, "106 sheets" should read --$10^6$ sheets--.
Line 67, "8 liens/mm" should read --8 lines/mm--.

COLUMN 26

Line 3, "while it was slightly" should be deleted.
Line 20, "background" should read --background fog--.

COLUMN 28

TABLE 3, "normal temperature-normal humidity conditions (23.5°C.-60% RH)" should read --normal temperature-very low humidity conditions (23°C-5% RH)--.

UNITED STATES PATENT AND TRADEMARK OFFICE

CERTIFICATE OF CORRECTION

PATENT NO. : 5,348,829

DATED : September 20, 1994

INVENTOR(S) : MASAKI UCHIYAMA, ET AL.

It is certified that error appears in the above-identified patent and that said Letters Patent is hereby corrected as shown below:

COLUMN 29

TABLE 3-continued,
"normal temperature-normal humidity conditions (23.5°C.-60% RH)" should read --normal temperature-very low humidity conditions (23°C-5% RH)--.
Line 19, "exhibit" should read --exhibits--.
Line 53, "0.5-3 μμm." should read --0.5-3 μm.--.

COLUMN 30

Line 30, "claim 11," should read --claim 1,--.
Line 34, "3-10%" should read --3-10% by--.
Line 37, "nonmag-" should read --non-mag- --.

COLUMN 32

Line 51, "claims 3-25." should read --claims 2-24.--.

Signed and Sealed this

Twenty-fifth Day of April, 1995

Bruce Lehman

*Attest:*

BRUCE LEHMAN

*Attesting Officer*

*Commissioner of Patents and Trademarks*